US005919102A

United States Patent [19]

Smith et al.

[11] Patent Number: 5,919,102

[45] Date of Patent: Jul. 6, 1999

[54] BASKETBALL SYSTEM WITH ADJUSTABLE HEIGHT GOAL

[75] Inventors: Max David Smith; John K. Story, both of Evansville, Ind.

[73] Assignee: Indian Industries, Inc., Evansville, Ind.

[21] Appl. No.: 09/026,583

[22] Filed: Feb. 20, 1998

[51] Int. Cl.[6] ..... A63B 63/08

[52] U.S. Cl. ..... 473/484

[58] Field of Search ..... 473/479, 481, 473/483, 484

[56] References Cited

U.S. PATENT DOCUMENTS

| | | | |
|---|---|---|---|
| D. 343,883 | 2/1994 | Hall | 473/484 X |
| 1,504,166 | 8/1924 | Thornley | 473/481 |
| 3,427,025 | 2/1969 | Procter | 473/483 |
| 4,798,381 | 1/1989 | Dadbeh | 473/484 |
| 4,801,142 | 1/1989 | Friesen | 473/484 |
| 4,805,904 | 2/1989 | Nye | 473/486 |
| 4,869,501 | 9/1989 | Anastasakis | 473/483 |
| 4,881,734 | 11/1989 | Nye | 473/484 |
| 5,098,092 | 3/1992 | Aakre et al. | 473/483 |
| 5,133,547 | 7/1992 | Pardi | 473/484 |
| 5,316,290 | 5/1994 | Parr et al. | 473/484 |
| 5,465,957 | 11/1995 | Schroeder | 473/484 |
| 5,478,068 | 12/1995 | Schroeder | 473/484 |
| 5,503,390 | 4/1996 | Hall | 473/484 |
| 5,570,880 | 11/1996 | Nordgren | 473/481 |
| 5,720,679 | 2/1998 | Schroeder | 473/484 |

FOREIGN PATENT DOCUMENTS 1152846 5/1969 United Kingdom .

*Primary Examiner*—William H. Grieb
*Attorney, Agent, or Firm*—Woodard, Emhardt, Naughton, Moriarty & McNett

[57] ABSTRACT

A mobile or permanently fixed basketball goal system wherein the backboard and hoop can be adjusted to a desired height by a user. The goal has a vertical support member having a base end, a backboard end and an intermediate portion, and a backboard including a hoop. Crossmembers pivotally connect the backboard to the vertical support member on one side of the backboard end, to form an adjustable parallelogram. At least one of the crossmembers extends beyond the vertical support member to an extension end. A clamp is mounted on a brace for the vertical support member or directly on the vertical support member. The clamp is fixedly adjustable within a continuous range and connects with the counterbalanced extension end via an extension member. When the clamp is moved, it acts to rotate the extending crossmember to raise or lower the backboard and hoop.

18 Claims, 4 Drawing Sheets

BASKETBALL SYSTEM WITH ADJUSTABLE HEIGHT GOAL

FIELD OF THE INVENTION

The present invention relates to the field of basketball systems, and particularly to an apparatus for adjusting the height of a basketball goal in such a system.

BACKGROUND OF THE INVENTION

The standard height of a basketball goal is ten (10) feet. However, this placement for the goal is frequently difficult for children and others to use. Thus, many families, particularly with small children, find it desirable to have a basketball goal at a height which is lower than the standard height. At the same time, it is desirable to have the goal adjustable to the standard height to insure that the users develop skills for use in the standard basketball situation.

For these and other reasons, there have been many attempts to design a basketball goal which is adjustable to several different heights. One design of an adjustable basketball goal employs a flexible cable and pulley which can be operated to raise or lower the goal to the desired height. The goal is then affixed at that height by tying off the cable. Disadvantages to this type of design are that adjustment is very slow and the cable often experiences a short life span because of its constant exposure to the weather. There is also the danger that injury could result if the cable breaks while the goal is in use.

Another design for an adjustable goal employs pivotally mounted parallel bars which connect the basketball backboard to a rigid mounting device such as a pole. The parallel bars combine with a basketball backboard and the rigid mounting device to form a parallelogram. Since the bars are pivotally mounted, they allow the backboard of the basketball goal to move to several different heights, while remaining vertically oriented. Typically, once the basketball goal is at the desired height, it is secured in place by tightening one or more bolts or other securement devices which lock the parallelogram in place.

One of the disadvantages of this type of device is that adjustment of the basketball goal requires the use of a ladder or similar device to enable one to reach the securing devices to change the height of the goal. It may also be difficult to change the position of the goal if it is necessary to support the weight of the backboard and the supporting arms while the adjustment is being made. It is also possible that the securing devices will become loosened or displaced while the goal is in use, in which event the goal may move from its desired position.

Yet another design for an adjustable basketball goal employs the same parallelogram-type structure, except that a telescoping ratchet mechanism is employed to secure the goal in the desired position. As the goal is raised a hinged pawl on one member engages a row of apertures in a second telescoping member in a ratchet-like fashion. This configuration permits the goal to be raised by applying an upward force on the basketball backboard, with the backboard being fixed into position when the pawl engages one of the apertures preventing downward movement when the upward force is removed. The goal can therefore be raised to any higher position from an intermediate position, but it cannot be lowered without neutralizing the pawl in some fashion. One disadvantage for this design comes for those units that require that the goal be raised to its highest position before the pawl is neutralized and the goal may be lowered.

A number of other systems have been used to secure a basketball goal at selected heights. Examples of the foregoing and other types of adjustable basketball goals are provided in U.S. Pat. No. 4,881,734 issued to Nye on Nov. 21. 1989; U.S. Pat. No. 4,869,501 issued to Anastasakis on Sept. 26, 1989; U.S. Pat. No. 4,805,904 issued to Nye on Feb. 21, 1989; and U.S. Pat. No. 4,798,381 issued to Dadbeh on Jan. 17, 1989. Many of these devices continue to use the parallelogram structure to ensure that the basketball backboard remains in a vertical position for the various heights of the goal.

Another design for an adjustable basketball goal is shown in U.S. Pat. Nos. 5,465,957 and 5,478,068 assigned to Porter Athletic Equipment Company of Broadview, Ill. This unit also employs a parallel set of arms attached to the basketball backboard and to a mounting pole. The lower arms terminate at the pole. However, the upper arms extend to the opposite side of the pole, and to which are attached the top end of a height adjustment counterbalance. This counterbalance consists of a rectangular tube which is filled with cement or a similar material to provide a weight which counters the weight of the basketball backboard, goal and supporting arms on the opposite side of the mounting pole. The lower end of the counterbalance includes a connecting mechanism, which can be secured to the pole at several specified heights corresponding to several holes vertically spaced on a pair of brackets. In order to adjust the height of the basketball goal, the counterbalance is disconnected from the pole by removing a retaining pin, and is raised or lowered to position the goal at the desired height. Once the goal is at the selected height, holes located at the bottom end of the counterbalance must be aligned with the bracket holes before the retaining pin can be inserted through the newly aligned holes to reattach the counterbalance to the mounting pole. This design suffers from the drawback that the counterbalance and the attached backboard and goal are not connected during adjustment and are unrestrained from abrupt vertical movement, causing possible safety concerns. Additionally, the alignment hole heights do not allow a continuous range of adjustment of the goal height, but only adjustment at preset corresponding heights.

Despite the various systems that have been proposed, there has remained a need for an adjustment mechanism which is easy to operate without employing a ladder or similar device, which is durable and able to withstand constant exposure to a variety of weather conditions, and which does not pose a danger to those who perform the adjustment or use the basketball goal.

SUMMARY OF THE INVENTION

A preferred embodiment of the present invention provides an adjustable basketball goal including a vertical support member having a base end, a backboard end and an intermediate portion, and has a backboard including a hoop. At least a first crossmember and a parallel extension crossmember connect the backboard to the vertical support member on one side of the backboard end, wherein the crossmembers are pivotally attached to the backboard and the vertical support member to form an adjustable parallelogram, and wherein the extension crossmember extends beyond the vertical support member and terminates in an extension end. The basketball goal system may be mobile or permanently fixed. If the system is mobile, a base is attached to the base end of the vertical support member and extends to a lateral end from the vertical support member in a direction opposite the side of the vertical support member on which the backboard is connected. A brace extends between the lateral end of the base and a point on the intermediate portion of the vertical support member.

A clamp is adjustably mounted on the brace or on the vertical support member and is fixable along a continuous range on the brace or vertical support member. An extension member is pivotally mounted to the clamp and extends to a pivotal mount on the extension end of the extension crossmember. In one preferred embodiment, the extension crossmember of the parallelogram is weighted with a ballast material to counterbalance the weight of the backboard and goal. When desired, the clamp is loosened and adjusted along the brace or vertical support member and, by leverage and torque, adjusts the height of the backboard. When the desired height is reached, the clamp is tightened to fix the selected height.

It is an object of the present invention to provide an adjustable basketball goal.

It is another object of the present invention to provide a durable basketball goal, which can be adjusted easily, simply and safely.

An object of a preferred embodiment of the present invention is to provide a basketball goal which is adjustable along a continuous range.

Further objects and advantages of the present invention will be apparent from the following description.

DESCRIPTION OF THE PREFERRED EMBODIMENT

For the purposes of promoting an understanding of the principles of the invention, reference will now be made to the embodiments illustrated and specific language will be used to describe the same. It will nevertheless be understood that no limitation of the scope of the invention is thereby intended, such alterations, modifications, and further applications of the principles of the invention being contemplated as would normally occur to one skilled in the art to which the invention relates.

Figure 1:
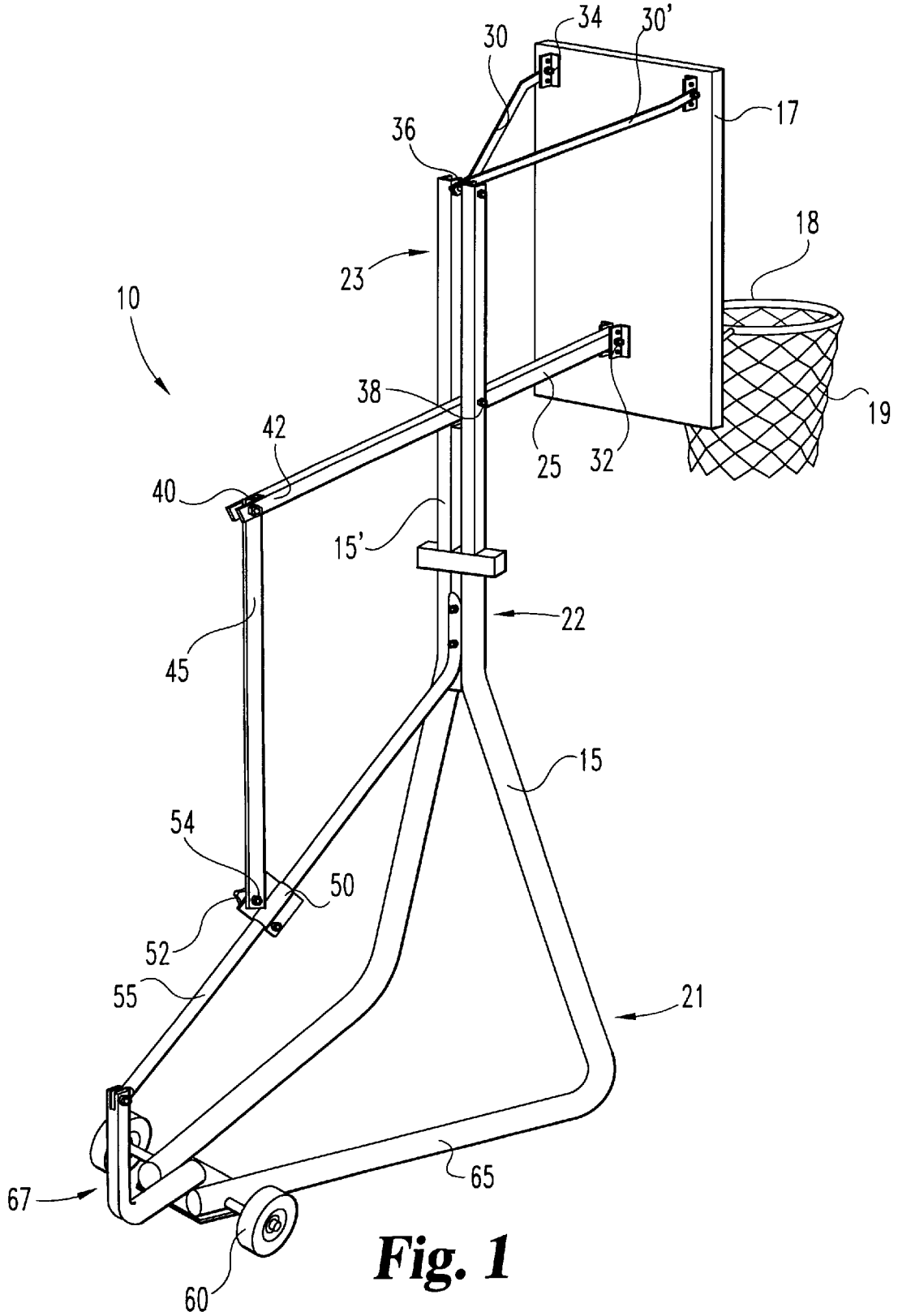
FIG. 1 is a perspective view of a preferred embodiment of the present invention.

In FIG. 1 a preferred embodiment of the adjustable basketball goal system 10 is shown. Basketball goal 10 includes a backboard 17 including a hoop 18 with net 19 sized and arranged as well understood by those of skill in the art. Adjustable basketball goal system 10 allows the height of backboard 17, hoop 18, and net 19 to be increased or decreased in accordance with the preference of the user.

Adjustable basketball goal 10 includes vertical support member 15, preferably a pole or, as illustrated, elongate members 15 and 15', standing in a generally vertical direction to align backboard 17 vertically when the basketball goal is in use. Vertical support member 15 has base end 21, backboard end 23 and intermediate portion 22. Vertical support member 15 is connected to backboard 17 on one side of vertical support member 15 by at least first crossmember 30 and extension crossmember 25, which are adjacent backboard end 23. First crossmember 30 and extension crossmember 25 are preferably made from steel pipes or beams. Extension crossmember 25 is pivotally mounted to vertical support member 15 and backboard 17 at pivot points 32 and 38. First crossmember 30 is pivotally mounted to backboard 17 and vertical support member 15 at pivot points 34 and 36. In a preferred embodiment, extension crossmember 25 extends past vertical support member 15 to extension end 42, which is on the opposite side of vertical support member 15 from backboard 17. Extension crossmember 25 is preferably mounted below first crossmember 30, however the extension crossmember could be mounted above the first crossmember. Extension crossmember 25 is preferably mounted below crossmember 30 to lower the center of gravity of the system and to shorten extension member 45. Third or fourth crossmembers, such as illustrated crossmember 30', may be mounted in parallel to first crossmember 30 or extension crossmember 25 to extend to opposing lateral sides of backboard 17.

Figure 5:
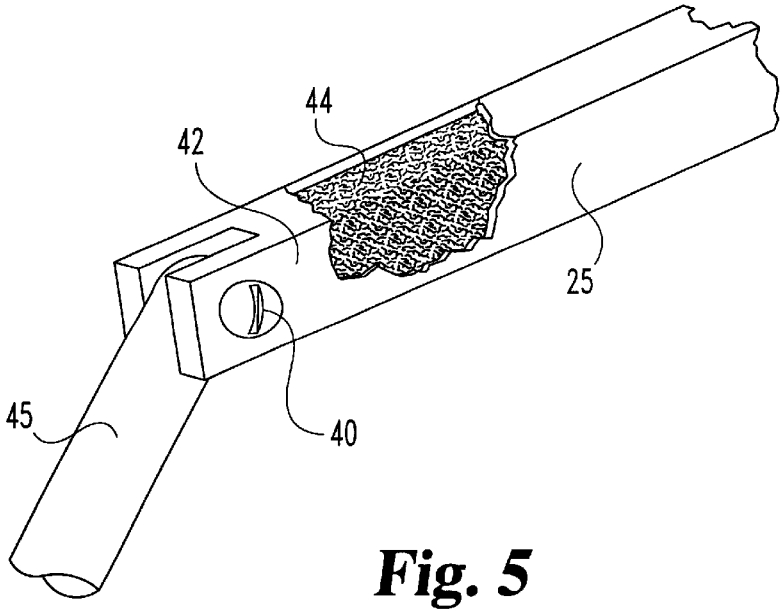
FIG. 5 is a cut-away view of the extension end of an extension crossmember according to a preferred embodiment of the inventions.

In one embodiment, extension end 42 of extension crossmember 25 is weighted to counterbalance the weight of backboard 17, hoop 18, and the portions of extension crossmember 25 and first crossmember 30 on the opposing side of vertical support member 15. Ballast material 44, such as sand or concrete, can be placed inside extension crossmember 25 adjacent to extension end 42 to supply the necessary weight for the counterbalance (FIG. 5). Alternatively, a solid pipe can be used at extension end 42 to provide the necessary counterbalance weight.

In a preferred embodiment of the invention, base end 21 of vertical support member 15 connects with base 65 which extends laterally from base end 21. Base 65 extends to lateral end 67. Optionally, at least one wheel 60, although preferably two, may be mounted on base 65 adjacent to lateral point 67. Brace 55 extends from lateral base end 67 to a point 22 intermediate vertical support member 15. Clamp 50 (discussed below) is mounted on brace 55 and has knob 52. Extension member 45 is pivotally mounted to extension end 42 of extension crossmember 25 at pivot point 40 and terminates at pivot point 54 on clamp 50.

As illustrated in FIG. 1, in one preferred embodiment, base 65 is formed from steel pipes which lead from opposing lateral ends of vertical support members 15 and 15' to form a stable horizontal isosceles triangle. The triangle has sides extending laterally from the ends of vertical support members 15 and 15' which intersect at an apex adjacent lateral end 67. In an alternate embodiment (not illustrated), base 65 is formed from a single piece of material having sufficient width to provide stability.

Figure 2:
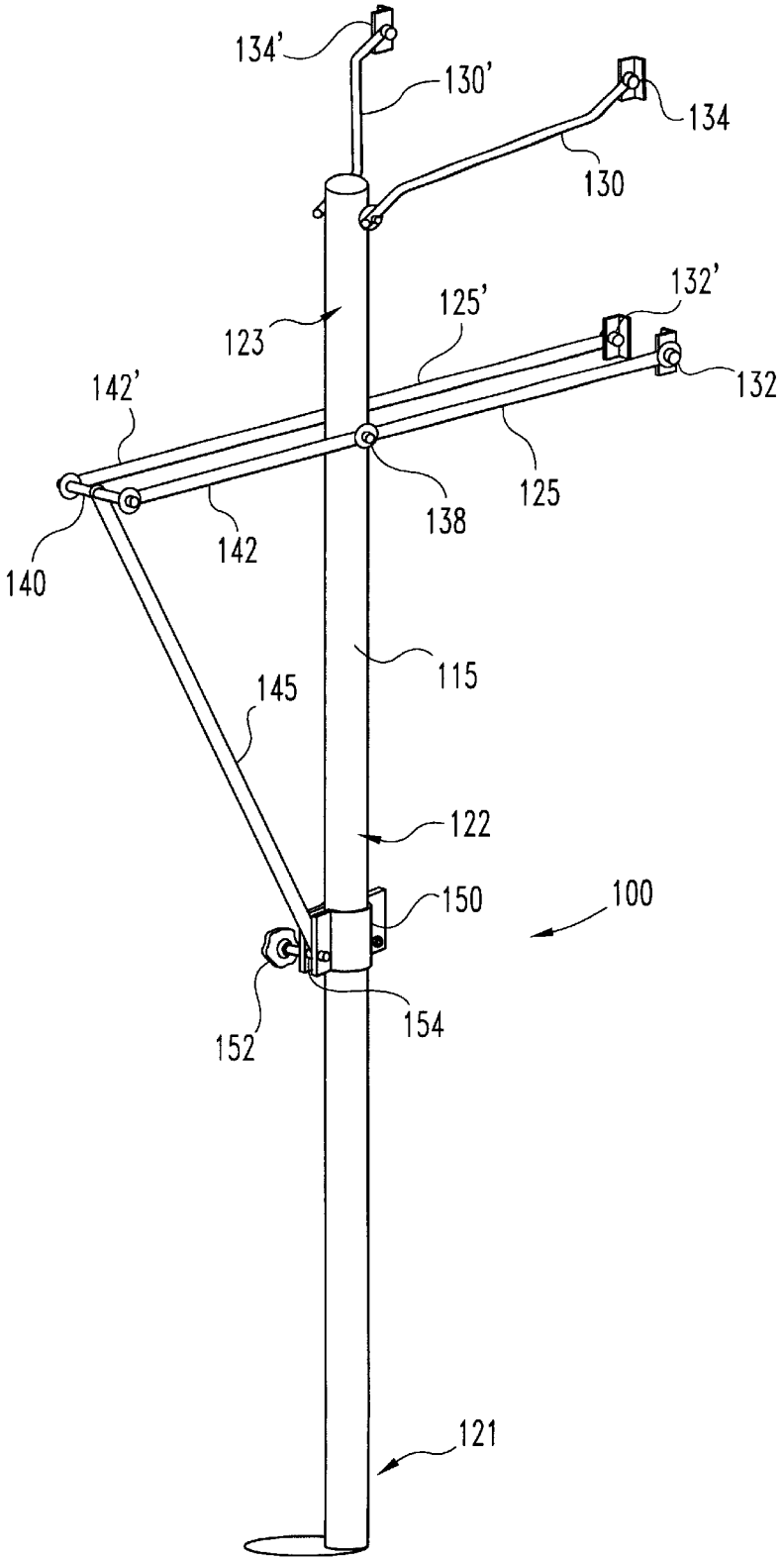
FIGS. 2 and 3 are perspective views of alternate preferred embodiments of the present invention.
Figure 3:
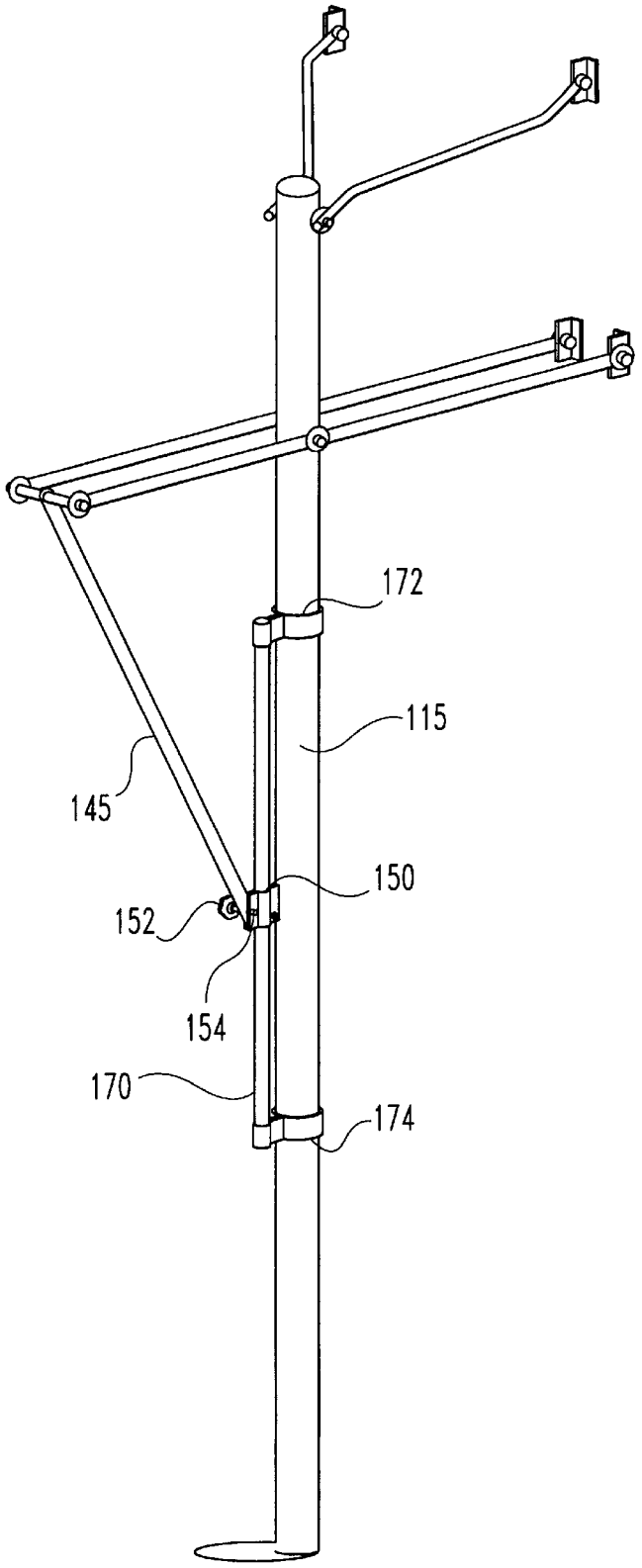

In FIGS. 2 and 3, alternate preferred embodiments of the invention are illustrated. In adjustable basketball goal 100, base point 121 of vertical support member 115 is fixed in place such as by embedding in the ground or in a concrete base. Adjacent to backboard end 123 of vertical support member 115, crossmembers 130, 130', 125 and 125' are pivotally mounted and extend to pivotable mounts 132, 132', 134 and 134' connected to a backboard (not shown). In a preferred embodiment, extension crossmembers 125 and 125' are mounted below first crossmembers 130 and 130' and have extension ends 142 and 142' which extend beyond vertical support member 115 opposite to the backboard. Extension member 145 extends from pivot point 140 at extension ends 142 and 142' to pivot position 154 on clamp 150 mounted on vertical support member 115.

Clamp 150 is mounted on vertical support member 115 at intermediate portion 122. Preferably, clamp 150 is an adjustable diameter sleeve controlled by knob 152. Knob 152 of clamp 150 functions similarly to knob 52 of clamp 50.

The embodiment in FIG. 3 is substantially similar to adjustable basketball goal 100. In FIG. 3, an offset member 170 is mounted on but offset from vertical support member 115. Offset brackets 172 and 174 are used to attach and retain offset member 170 to vertical support member 115. In FIG. 3, extension member 145 extends to a pivot point 154 on clamp 150 which is mounted on offset member 170. Knob 152 on clamp 150 functions as previously described.

Figure 4:
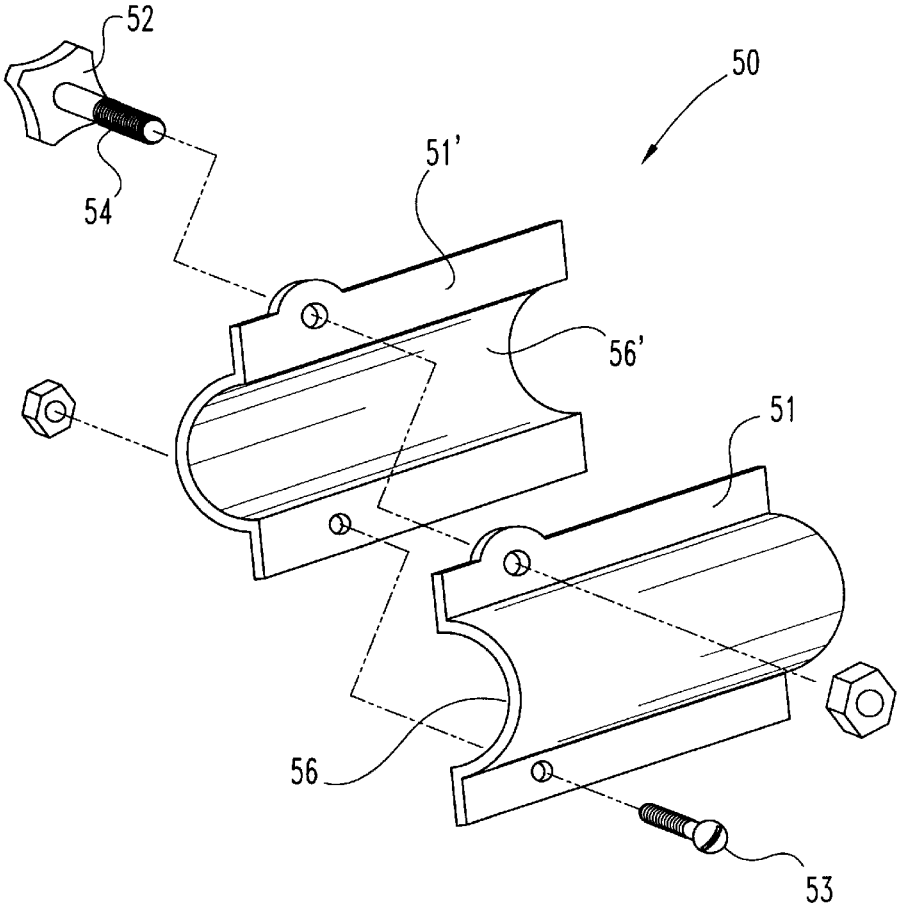
FIG. 4 is a disassembled view of a preferred clamp of the present invention.

As illustrated in disassembled form in FIG. 4, clamp 50 is a clamp which is selectively fixable at any point within a range along a brace or a vertical support member and is continuously adjustable. In a preferred embodiment, clamp 50 is an adjustable diameter sleeve made from two elongate plates 51 and 51' with semicircular channels 56 and 56'. Knob 52 is a threaded rod and grip, which attaches to clamp 50 with a threaded nut and which may be rotated to tighten or loosen clamp 50 on the enclosed member. The threaded rod of knob 52 may also define an axis to provide pivot point 54 for the termination of extension rod 45. Bolt 53 opposite knob 52 is used to connect the opposing sides of plates 51 and 51'. Alternate clamp configurations include band clamps, C clamps, clamps with setscrews interlocking plates or other devices which may be tightened in place or loosened for adjustment along a continuous range.

As illustrated for one embodiment in FIG. 5, extension end 42 of extension crossmember 25 is weighted with ballast material 44 to counterbalance the affect of the backboard and crossmembers on the opposing side of the vertical member. This weight may be sand, cement, stone or other types of ballast material or may be provided by solid pipe. Preferably, the weighted leverage of the counterbalance is approximately equal to the weighted leverage of the backboard and opposing crossmember sections; however, the counterbalance weight could be more or less as desired to ease adjustment in one direction. As another alternative, the ballast material forming the counterbalance may be within or part of extension member 45. In other embodiments, extension ends 142 and 142' of extension crossmembers 125 and 125' are weighted in a similar manner.

When the preferred embodiment illustrated in FIG. 1 is in use, adjustable basketball goal 10 may be wheeled to a desired location. This may be done by tilting vertical support member 15 to lift base end 21 and base 65 and then rolling the adjustable basketball goal 10 using wheels 60. Once adjustable basketball goal 10 is in place, the height of backboard 17 and hoop 18 may be adjusted. In order to adjust the height, knob 52 of clamp 50 is loosened, thus loosening the grip of clamp 50 on brace 55 without disconnecting clamp 50 from brace 55. Once clamp 50 is loose, it may be adjusted within a continuous range along brace 55. When clamp 50 is moved, it causes extension arm 45 to pivot at pivot point 54 and to push or pull extension end 42 at pivot point 40. When extension end 42 is pushed or pulled it will rotate extension crossmember 25 to raise or lower backboard 17 at pivot point 32, by lever action around pivot point 38. First crossmember 30, extension crossmember 25, vertical support member 15 and backboard 17 form a parallelogram so that when extension crossmember 25 is rotated the parallelogram shape will be maintained and the backboard will be maintained in a vertical position. Once the desired height of backboard 17 is achieved, knob 52 of clamp 50 is tightened to fix clamp 50 at the selected spot on brace 55 and to maintain the height of backboard 17.

According to the preferred embodiments in FIGS. 2 and 3, the height of the backboard may be selected by the user along a continuous range. To adjust the height of the backboard, clamp 150 is loosened using knob 152 until clamp 150 may be moved. Clamp 150 may then be raised or lowered along vertical support member 115 or offset member 170 to lever the extension member and crossmembers until the backboard is at the desired height. Knob 152 is then tightened to fix clamp 150 in the selected location. In FIG. 3, offset member 170 provides an upper and lower limit defined by offset brackets 172 and 174 beyond which clamp 150 may not be moved.

Preferably, the vertical support member, crossmembers, offset member and extension member are made of steel pipes or beams having circular, square or rectangular cross sections; however, it will be understood that alternate materials and geometries may be used. Similarly, the knob on clamp 50 or 150 is preferably made from plastic, metal, ceramic or other well known materials and is attached to or integral to a threaded rod providing pivot point 54 or 154.

Also preferably, clamp 50 or 150 along brace 55 or vertical support member 115 is within a range which is convenient and comfortable for users to reach and which therefore facilitates adjustment of the backboard height. It is advantageous to have clamp 50 or 150 closely approximate the diameter of the brace or vertical support member and not removed from its mount even when clamp 50 or 150 is in its loosened state. This provides a safety factor due to the torque of the clamp on the brace or vertical support member. Extension members 45 or 145 do not push or pull clamp 50 or 150 in parallel to the clamp's mount, thus creating a torque which resists the clamp sliding in an unrestrained manner.

While the invention has been illustrated and described in detail in the drawings and description, these are to be considered as illustrative and not restrictive. It must be understood that only preferred embodiments have been shown and described and that all changes and modifications that come within the spirit of the invention are included where described by the following claims.

What is claimed is:

1. An adjustable basketball goal, comprising:

a) a vertical support member having a base end, a backboard end and an intermediate portion;

b) a backboard including a hoop;

c) at least a first crossmember and a parallel extension crossmember connecting said backboard to said vertical support member on one side of said backboard end, wherein said crossmembers are pivotally attached to said backboard and said vertical support member to form an adjustable parallelogram, and wherein said extension crossmember extends beyond said vertical support member and terminates at an extension end;

d) a base attached to said base end of said vertical support member and extending to a lateral end from said vertical support member in a direction opposite the side of said vertical support member to which said backboard is connected;

e) a brace extending between said lateral end of said base and a point on said intermediate portion of said vertical support member;

f) a clamp adjustably mounted on said brace and fixable in selected positions on said brace;

g) a knob associated with said clamp to tighten or loosen said clamp; and, h) an extension member pivotally mounted to said clamp and extending to a pivotal mount on said extension end of said extension crossmember.

2. The basketball goal of claim 1 further comprising at least one wheel mounted adjacent to said lateral end of said base.

3. The basketball goal of claim 1 wherein said extension crossmember counterbalances said backboard and hoop.

4. The basketball goal of claim 3 wherein said extension crossmember is weighted with ballast material within said extension end of said extension crossmember.

5. The basketball goal of claim 1 wherein said clamp is an adjustable diameter sleeve.

6. The basketball goal of claim 5 wherein said clamp is fixable within a continuous range of selected positions along said brace.

7. The basketball goal of claim 6 wherein said extension crossmember is mounted below said first crossmember.

8. The basketball goal of claim 7 further comprising a third crossmember mounted in parallel with said first crossmember and wherein said first and third crossmembers extend from said vertical support member to opposing lateral sides of said backboard.

9. An adjustable basketball goal, comprising:

a) a vertical support member having a base end, a backboard end and an intermediate portion;

b) a backboard including a hoop;

c) at least a first crossmember and a parallel extension crossmember connecting said backboard to said vertical support member on one side of said backboard end, wherein said crossmembers are pivotally attached to said backboard and said vertical support member to form an adjustable parallelogram, and wherein said extension crossmember extends beyond said vertical support member to terminate in an extension end wherein said extension end counterbalances said backboard;

d) a clamp adjustably mounted on said vertical support member and fixable within a continuous range of selected positions on said vertical support member;

e) a knob associated with said clamp to tighten or loosen said clamp; and, f) an extension member pivotally mounted to said clamp and extending to a pivotal mount on said extension end of said extension crossmember.

10. The basketball goal of claim 9 wherein in said clamp is an adjustable diameter sleeve.

11. The basketball goal of claim 10 wherein said extension end of said extension crossmember is weighted with ballast material.

12. The basketball goal of claim 11 wherein said ballast material is within said extension crossmember.

13. The basketball goal of claim 12 wherein said extension crossmember is mounted below said first crossmember.

14. An adjustable basketball goal, comprising:

a) a vertical support member having a base end, a backboard end and an intermediate portion;

b) a backboard including a hoop;

c) at least a first crossmember and a parallel extension crossmember connecting said backboard to said vertical support member on one side of said backboard end, wherein said crossmembers are pivotally attached to said backboard and said vertical support member to form an adjustable parallelogram, and wherein said extension crossmember extends beyond said vertical support member to terminate in an extension end wherein said extension end is weighted;

d) an offset member mounted on and parallel to said vertical support member;

e) a clamp adjustably mounted on said offset member and fixable within a continuous range of selected positions on said offset member;

f) a knob associated with said clamp to tighten or loosen said clamp; and, g) an extension member pivotally mounted to said clamp and extending to a pivotal mount on said extension end of said extension crossmember.

15. The basketball goal of claim 14 wherein said offset member extends along a length of said vertical support member and provides an upper limit and a lower limit for adjustment of said clamp.

16. The basketball goal of claim 14 wherein said clamp is an adjustable diameter sleeve.

17. The basketball goal of claim 16 wherein said extension end of said extension crossmember is weighted with ballast material within said extension crossmember.

18. The basketball goal of claim 17 wherein said extension crossmember is mounted below said first crossmember.

* * * * *

UNITED STATES PATENT AND TRADEMARK OFFICE

CERTIFICATE OF CORRECTION

PATENT NO : 5,919,102

DATED : July 6, 1999

INVENTOR(S) : Max David Smith, et al.

It is certified that error appears in the above-identified patent and that said Letters Patent is hereby corrected as shown below:

In column 1, line 53, please insert a comma after "raised".
In column 6, line 11, please change "geometries" to –geometrics--.

Signed and Sealed this

Eleventh Day of April, 2000

*Attest:*

*Attesting Officer*

Q. TODD DICKINSON

*Director of Patents and Trademarks*